United States Patent [19]

VandenHoek et al.

[11] 4,193,233

[45] Mar. 18, 1980

[54] ADJUSTABLE PANEL STABILIZER

[75] Inventors: Harold L. VandenHoek; Frank S. Breiner, both of Grand Rapids, Mich.

[73] Assignee: Steelcase Inc., Grand Rapids, Mich.

[21] Appl. No.: 909,120

[22] Filed: May 24, 1978

[51] Int. Cl.[2] ..... E04D 15/00

[52] U.S. Cl. ..... 52/122; 248/188; 248/188.8

[58] Field of Search ..... 52/65, 71, 239, 122; 160/351; 248/188, 188.7, 188.8

[56] References Cited

U.S. PATENT DOCUMENTS

| | | | |
|---|---|---|---|
| 3,601,346 | 8/1971 | Fenwick | 248/188.8 |
| 3,794,281 | 2/1974 | Munsey | 248/188 |
| 3,844,079 | 10/1974 | Karrip | 52/221 |
| 3,885,361 | 5/1975 | De Schutter | 52/122 |
| 4,000,592 | 1/1977 | Kelly | 52/149 |
| 4,038,790 | 8/1977 | Paisley | 52/36 |
| 4,056,903 | 11/1977 | Guarnere | 52/122 |

*Primary Examiner*—Carl D. Friedman

[57] ABSTRACT

The specification discloses a stabilizer for free standing room divider panels in which a vertical leg includes a hook bracket which hooks into a slotted standard on the panel and a foot projects laterally from the leg and engages the floor. The hooked bracket includes hooks which face upwardly instead of downwardly. Instead of providing a leveler on the foot, the hook bracket is adjustably positioned within the leg so that the hooks can be adjusted upwardly into their receiving slots while the foot remains flush on the floor.

23 Claims, 7 Drawing Figures

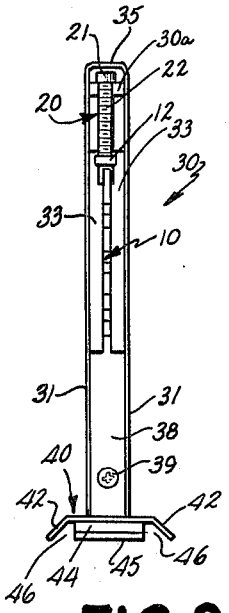
FIG. 2.
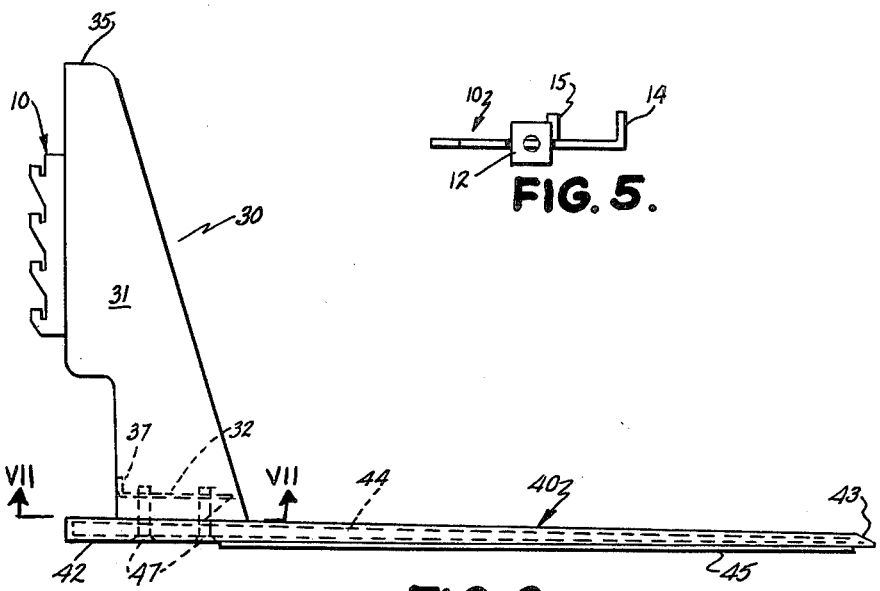
FIG. 3.
FIG. 5.
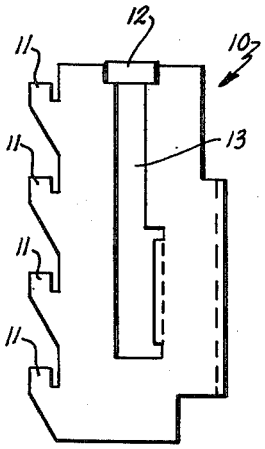
FIG. 4.
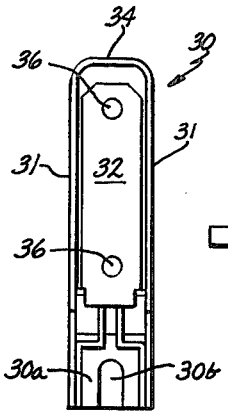
FIG. 7.
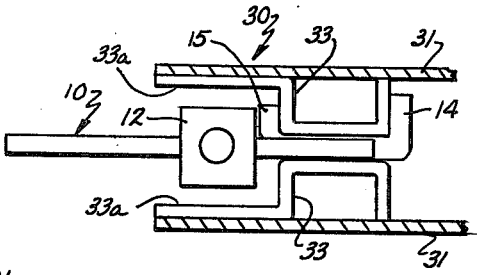
FIG. 6.

ADJUSTABLE PANEL STABILIZER

BACKGROUND OF THE INVENTION

The present invention relates to movable, free standing partitions or panels. It is common in such panel systems to provide a stabilizer located at the bottom of the panel to help prevent it from tipping to one side or the other.

Usually, such stabilizers are L-shaped, including a leg which abuts the panel and a foot which projects laterally from the leg and engages the floor. Stabilizers have been secured to panels in a variety of ways, including through use of hooks which hook down into the slotted standard which such free standing panels usually have.

Because floors are uneven, the panels themselves are provided with levelers which can adjust the height of the panel upwardly or downwardly at either end. The stabilizer foot then also has to have some sort of leveler glide, usually located at the end of the foot, in order to level the foot commensurate with the level of the panel and thereby prevent the panel from rocking.

A problem with such systems is that people stumble over the projecting foot. This is especially true if it is necessary to adjust the panel leveler and accordingly, the foot leveler upwardly. This also makes the foot more unsightly.

SUMMARY OF THE INVENTION

In the present invention, a stabilizer for free standing panels is provided in which the attachment means for attaching the stabilizer to the panel is movably mounted on track means hidden within the vertical leg of the stabilizer. Adjustment means operably connect the attachment means to the stabilizer and allow one to adjust the attachment means upwardly or downwardly. As a result, one can make a proper adjustment for the level of the panel without changing the level of the stabilizer.

Consequently, the stabilizer foot, which in a preferred aspect of the invention is made in a very low profile, can continuously remain firmly seated on the supporting floor, regardless of whether or not the level of the panel is adjusted upwardly or downwardly. There is no need to provide a leveler on the stabilizer foot itself.

These and other objects, advantages and features of the invention will be more fully understood and appreciated by reference to the written specification and appended drawings.

BRIEF DESCRIPTION OF THE DRAWINGS

FIG. 2 is an end view of the stabilizer, looking at the end which would be attached to the panel;

FIG. 3 is a side elevational view of the stabilizer;

FIG. 4 is a side elevational view of the attachment means alone which is movably mounted in the stabilizer;

FIG. 5 is a top plan view of the attachment means;

FIG. 6 is a top plan view of the attachment means located within its receiving track within the stabilizer leg; and FIG. 7 is a bottom plan view of the leg portion of the stabilizer separated from the foot, looking upwardly generally along the plane VII—VII of FIG. 3.

DESCRIPTION OF THE PREFERRED EMBODIMENT

Figure 1:
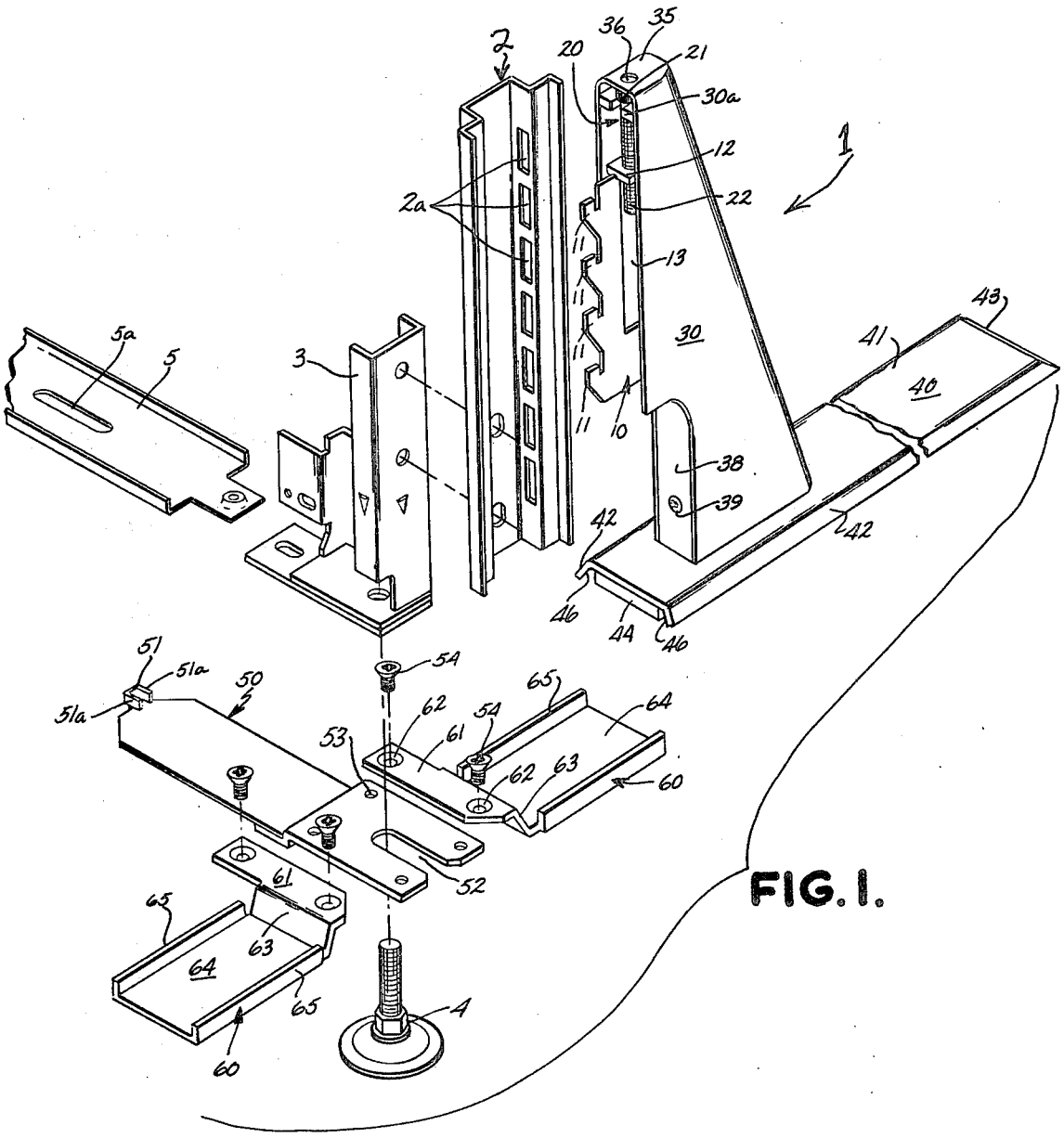
FIG. 1 is an exploded view of a stabilizer made in accordance with the present invention and of the pertinent components of a panel to which the stabilizer would be secured.

In the preferred embodiment, stabilizer 1 includes an attachment bracket 10 which hooks upwardly into the slot within a slotted standard 2 which is part of the panel assembly which stabilizer 1 is to stabilize (FIG. 1). Attachment bracket 10 is movably mounted within stabilizer 1 and can be adjusted up and down by means of a threaded adjustment screw 20.

Stabilizer 1 is made of two metal parts, an upwardly extending leg 30 and a horizontally extending foot 40. Leg 30 includes spaced sidewalls 31 joined by a front leading edge wall 34 (FIGS. 1, 2, 3 and 7). It is closed at the top by a top wall 35 (FIG. 1). Top wall 35 includes an aperture 36 therein which allows access of a tool to adjustment screw 20.

Leg 30 includes an inverted generally U-shaped cross sectioned mounting bracket 32 in the bottom thereof with a pair of spaced threaded holes 36 therein (FIGS. 3 and 7). The walls of the "U" are welded to the inside of the opposite walls 31 of leg 30. It is by means of this mounting bracket 32 that projecting foot 40 is secured to leg 30. Bracket 32 includes an upwardly projecting flange 37 at one end thereof which also includes an aperture and into which a screw 39 can be threaded to secure a cover plate 38 onto leg 30 generally at the bottom thereof (FIG. 2).

Located within leg 30 are a pair of spaced side rails 33 with a space therebetween defining a track within which attachment bracket 10 is slidably located (FIGS. 2 and 6). Rails 33 extend from near the top of leg 30 to a point a little more than halfway down the height thereof. Each rail 33 is generally C-shaped, but includes a mounting flange **33*a*, extending laterally from the base of one leg of the "C" which is mounted to the inside of a sidewall 31**.

Leg 30 includes a shoulder plate **30*a* welded therein near the top thereof to serve as a shoulder against which the head 21 of adjustment bolt 20 bears (FIGS. 1, 2 and 7). Shoulder plate 30*a* includes a slot 30*b* therein (FIG. 7) which opens outwardly such that the threaded shank 22 of bolt 20** can readily be slid therein.

Bolt 20 is conventional including a head 21 which is adapted to receive an Allen wrench. Threaded shaft 22 extends downwardly from head 21.

Attachment bracket 10 includes a rear tracking flange 14 located at the rear thereof and a front tracking flange 15 located approximately midway thereof. Track flanges 14 and 15 embrace either side of one of the rails 33 (FIGS. 5 and 6). In this way, attaching bracket 10 slides up and down between rails 33, while tracking on one of the rails.

Attachment bracket 10 is formed of metal and includes upwardly projecting hooks 11 projecting from one edge thereof (FIGS. 1, 3 and 4). Welded to the top of attachment bracket 10 generally at the center thereof is a nut 12 (FIGS. 1, 2, 4 through 6). The space below nut 12 within the body of attachment bracket 10 is cut out to define a bolt clearance area 13 (FIG. 4). The threaded shaft 22 of adjustment bolt 20 extends into clearance area 13 as it is threaded into nut 12 (FIG. 1).

Foot 40 is very flat and has a low profile when viewed in side elevation (FIG. 3). It is made of steel and comprises a top wall 41, a pair of spaced side edges 42, a front end edge 43 and an open back (FIGS. 1, 2 and 3). It is reinforced by a plate 44 which extends generally from the rear of foot 40 to the front and is welded to the underside of top wall 41. Plate 44 is slightly less thick than the vertical thickness of side edges 42. Plate 44 is narrower than the width of foot 40 so that there is a space 46 between each side edge of plate 44 and the inside surface of the side edge wall 42. This accommodates lateral stability channel 60 as will be explained hereinafter.

Secured to the bottom of plate 44 is a rubber pad 45 which provides a fraction gripping surface to grip a floor. Pad 45 extends generally from the toe of foot 40 (at the right end as viewed in FIG. 3) to a point which is spaced from the heel of foot 40 a distance sufficient to accommodate the length of rigidifier channel 60 (FIGS. 1 and 3). Channel 60 is at least slightly thinner than pad 45 so it does not engage the floor. Pad 45 projects just a slight distance below the level of side edge walls 42 and end edge wall 43 so that one is sure that pad 45 will engage the floor rather than the hard edges of edge walls 42 and 43.

There are apertures which extend through foot 40, including plate 44, generally at the heel thereof so that screws 47 can pass therethrough and be threaded into the threaded apertures 36 in inverted U-bracket 32 of leg 30 to thereby secure foot 40 to leg 30.

While probably an unnecessary precaution, the preferred embodiment also contemplates a rigidifying system to prevent any possibility of stabilizer 1 twisting from side to side when it is attached to the slotted standard 2 on a panel. To more fully understand this system, it is necessary to describe some of the further components which make up the panel assembly to be supported by stabilizer 1. At the bottom corner of each panel there is a foot 3 into which a leveler glide 4 can be threaded (FIG. 1). Extending between and being secured to the feet 3 at each corner is a bottom plate 5 which includes a slot 5*a* therein. Plate 5 is secured by a screw at each end to foot 3.

The rigidifier system includes a mounting plate 50 to which can be secured at either side, depending on whether or not a stabilizer 1 is located on that particular side, a rigidifier channel 60. Plate 50 is made of steel and includes a projecting catch 51 at one end and a slot 52 at the other end which opens outwardly through the end of plate 50. By sliding slot 52 over the threaded shank of leveler 4 and by then hooking projecting catch 51 up into slot 5*a*, one can secure plate 50 in place.

Catch 51 includes a pair of spaced tangs 51*a* which can be bent out once catch 51 is located within slot 5*a* to thereby prevent removal of plate 50 without bending tangs 51*a* back inwardly. At one end, plate 50 includes a pair of threaded holes 53 located towards either side thereof into which bolts 54 can be threaded to secure rigidifier channel 60 to plate 50.

Rigidifier channel 60 includes a mounting flange 61 at one end thereof having apertures 62 therein through which bolts 54 pass. A sloped wall 63 extends downwardly from mounting flange 61 and is joined to a bottom wall 64. Projecting upwardly at either side of bottom wall 64 is a sidewall 65, such that bottom wall 64 and spaced sidewalls 65 define a channel. Spaced sidewalls 65 are sufficiently short that they can slide into the spaces 46 at the open end of stabilizer foot 40 and embrace either side of plate 44. Bottom wall 64 fits in snugly against the bottom of plate 44 and does not project below the level of rubber pad 45.

In operation, one first levels the panel to which stabilizer 1 is to be attached by threading leveler 4 up or down within foot 3. One then pushes stabilizer 1 up against the panel such that the hooks 11 project into slots 2*a* in slotted standard 2. One then inserts an Allen wrench through hole 36 and rotates adjustment bolt 20 until the hooks 11 hook tightly upwardly into the slots 2*a*. Stabilizer 1 is now firmly in place with foot 40 lying flat against the floor surface.

If further rigidity is desired, one can employ plate 50 and channel 60 by slipping slot 52 over the shank of leveler 4, inserting catch 51 up into slot 5*a* and opening tangs 51*a*. One then bolts channel 60 to plate 50 with sidewalls 65 extending into the spaces 46 and embracing either side of plate 44 in the bottom of foot 40. Stabilizer 1 will now be prevented from any type of twisting motion.

Of course, it is understood that the above is merely a preferred embodiment of the invention and that various changes and alterations can be made without departing from the spirit and broader aspects thereof.

The embodiments of the invention in which an exclusive property or privilege is claimed are defined as follows:

1. In a stabilizer having attachment means for attaching the stabilizer to a free standing panel, the improvement comprising: said stabilizer including a vertical leg which is at least partially hollow on the interior therof, said hollow interior opening to the rear of said leg; track means located within said hollow of vertical leg, said attachment means being movably mounted upon said track means within said stabilizer leg and projecting rearwardly through said opening; adjustment means securing said attachment means to said stabilizer whereby one can move the attachment means up or down on said track means within said stabilizer leg by operating said adjustment means thereby facilitating adjustment of the stabilizer relative to a panel without actually changing the level of the stabilizer foot on the floor on which it rests.

2. The stabilizer of claim 1 in which said attachment means comprising a bracket having hooks projecting therefrom, said hooks projecting upwardly relative to said stabilizer whereby said hooks hook upwardly into slots in a panel.

3. The stabilizer of claim 2 which includes a flat, low profile horizontal foot extending from the base of said leg.

4. The stabilizer of claim 1 in which said track means comprises a pair of rails with a space therebetween, said attachment means being located within said space between said rails and including flange means for embracing opposite sides of said rails.

5. The stabilizer of claim 4 in which said adjustment means comprises a threaded bolt rotatably mounted within said stabilizer, limiting means in said stabilizer limiting said bolt from vertical movement, said attachment means including a nut secured thereto into which said threaded bolt is threaded.

6. The stabilizer of claim 5 in which said attachment means includes a clearance space for the threaded shank of said bolt.

7. The stabilizer of claim 6 in which said limiting means comprise the top of said stabilizer and a shoulder plate secured within said stabilizer and spaced a short distance from said top; said shoulder plate being spaced from said top a distance just sufficiently large to accommodate the head on said adjustment bolt.

8. The stabilizer of claim 5 in which said limiting means comprise the top of said stabilizer and a shoulder plate secured within said stabilizer and spaced a short distance from said top; said shoulder plate being spaced from said top a distance just sufficiently large to accommodate the head on said adjustment bolt.

9. The stabilizer of claim 1 in which said adjustment means comprises a threaded bolt rotatably mounted within said stabilizer leg, limiting means in said stabilizer leg limiting said bolt from vertical movement, said attachment means including a nut secured thereto into which said threaded bolt is threaded.

10. The stabilizer of claim 10 in which said attachment means includes a clearance space for the threaded shank of said bolt.

11. The stabilizer of claim 1 which includes a flat, low profile horizontal foot extending from the base of said leg.

12. The stabilizer of any one of the preceding claims combined with a panel assembly including a panel foot at the bottom corner thereof, a leveler glide threaded into said panel foot and a bottom wall extending along the bottom of said panel away from said panel foot; a generally L-shaped rigidifier assembly having a first plate secured to said bottom wall of said panel assembly and a channel-shaped leg extending generally perpendicular therefrom, said channel-shaped leg having a bottom wall which extends beneath the bottom of said stabilizer and spaced sidewalls which embrace the bottom of said stabilizer.

13. The stabilizer and assembly of claim 12 in which said bottom of said stabilizer includes a pair of spaced recesses therein into which said sidewalls of said channel extend.

14. The stabilizer and assembly of claim 13 in which said first plate of said generally L-shaped rigidifier assembly includes a slot extending from one end thereof which fits over the leveler glide, and a catch at the other end thereof; said bottom wall of said panel assembly including a slot therein into which said catch projects to thereby secure said generally L-shaped rigidifier assembly to said panel.

15. The stabilizer and assembly of claim 14 in which said catch includes a pair of tangs which can be bent away from one another to prevent said catch from being removable from said slot in said bottom wall of said panel assembly.

16. The stabilizer of claim 1 combined with a panel, said panel including means receiving said attachment means.

17. The stabilizer and panel of claim 16 in which said means receiving said attachment means comprise slots and said attachment means comprises a bracket having hooks projecting therefrom, said hooks projecting upwardly relative to said stabilizer and hooking into said slots in said panel.

18. The stabilizer of claim 17 which includes a flat, low profile horizontal foot extending from the base of said leg.

19. The stabilizer of claim 18 in which said track means comprises a pair of rails with a space therebetween, said attachment means being located within said space between said rails and including flange means for embracing opposite sides of said rails.

20. The stabilizer of claim 19 in which said adjustment means comprises a threaded bolt rotatably mounted in said stabilizer, limiting means in said stabilizer limiting said bolt from vertical movement, said attachment means including a nut secured thereto into which said threaded bolt is threaded.

21. The stabilizer of claim 20 in which said attachment means includes a clearance space for the threaded shank of said bolt.

22. The stabilizer of claim 21 in which said limiting means comprise the top of said stabilizer and a shoulder plate secured within said stabilizer and spaced a short distance from said top; said shoulder plate being spaced from said top a distance just sufficiently large to accommodate the head on said adjustment bolt.

23. The stabilizer of any one of claims 1, 2, 3, 5, 14, 16, 17, 18, or 19 in which said adjustment means operably connects said attachment means to said stabilizer whereby operation of said adjustment means in and of itself moves said attachment means in said track means.

* * * * *

UNITED STATES PATENT AND TRADEMARK OFFICE

CERTIFICATE OF CORRECTION

PATENT NO. : 4,193,233

DATED : March 18, 1980

INVENTOR(S) : VandenHoek et al.

It is certified that error appears in the above-identified patent and that said Letters Patent are hereby corrected as shown below:

Column 5, line 13:

"10" should be --- 9 ---

Column 6, line 18:

"18" should be --- 17 ---

Column 6, line 38:

"5, 14" should be --- 4, 11 ---

Signed and Sealed this

*First* Day of *July 1980*

[SEAL]

*Attest:*

SIDNEY A. DIAMOND

*Attesting Officer*

*Commissioner of Patents and Trademarks*